US007059743B2

(12) United States Patent
Niemann

(10) Patent No.: US 7,059,743 B2
(45) Date of Patent: Jun. 13, 2006

(54) RECHARGEABLE LED LIGHTING AND FLASHING APPARATUS

(76) Inventor: Bradley Q. Niemann, 679 Washboard Trail, Hillsboro, IL (US) 62049

( * ) Notice: Subject to any disclaimer, the term of this patent is extended or adjusted under 35 U.S.C. 154(b) by 213 days.

(21) Appl. No.: 10/664,361

(22) Filed: Sep. 22, 2003

(65) Prior Publication Data

US 2005/0063179 A1 Mar. 24, 2005

(51) Int. Cl.
*F21V 4/02* (2006.01)

(52) U.S. Cl. ..... 362/184; 362/205; 362/251; 362/221

(58) Field of Classification Search ..... 362/194, 362/195, 205, 249, 251, 396, 398, 368, 285, 362/221, 222, 223, 171, 174
See application file for complete search history.

(56) References Cited

U.S. PATENT DOCUMENTS 6,095,661 A 8/2000 Lebens
2002/0191396 A1* 12/2002 Reiff et al. ..... 362/246

* cited by examiner

*Primary Examiner*—Sandra O'Shea
*Assistant Examiner*—Guiyoung Lee
(74) *Attorney, Agent, or Firm*—Don W. Weber

(57) ABSTRACT

A clear, hollow cylindrical tube having an internal circuit board with LED lights provides a lighting and flashing illumination device. The LED lights may either all be illuminated at once, or have certain LEDs with constant illumination while other LEDs may be placed into a flashing mode. The power source for the lighting and flashing apparatus includes either standard or rechargeable batteries and a 12-volt external source. The 12-volt external source may also be used to recharge the rechargeable batteries. The cylinder has an upper collar with both magnetic and hook hanging mechanisms. The rechargeable LED lighting and flashing apparatus provides much more illumination than a flashlight using standard charging and lighting electrical parts.

6 Claims, 3 Drawing Sheets

RECHARGEABLE LED LIGHTING AND FLASHING APPARATUS

BACKGROUND OF THE INVENTION

This invention relates to the field of illumination devices. More particularly, a unique rechargeable LED lighting and flashing apparatus is presented which provides much more light than the usual flashlight and which also has a flashing feature.

Many improvements have been made in the field of lighting over the centuries. From lighting by fire, to torches, to gas lights, to automobile and battery-powered lights, many new innovations have adapted the current technology to the need to provide lighting at remote or inaccessible locations. The common flashlight was devised to provide a portable source of light using is standard batteries.

Improvements to the standard flashlight have also included rechargeable batteries, flashing circuitry, and different types and sizes of flashlights as well as other portable illumination devises. With the invention of LEDs (light emitting diodes) a new means to provide illumination has been made available. Generally, LED lights are much brighter and therefore provide much more illumination for the portable flashlight or lighting device. It is an object of this invention to provide a very bright, portable illumination apparatus utilizing LEDs.

Another advantage of the use of LED lights is that these tiny lights may be programmed by a circuit board or computer chip to perform varying functions, for example, flashing or chasing. It is another object of this invention to provide an LED illumination device that may also have flashing characteristics.

Illumination devices are quite functional, although the standard batteries often require replacement during the use of the device. One effort to improve the limited power supply of a standard flashlight was accomplished through the use of rechargeable batteries. However, the rechargeable batteries normally required a portable charger and a 120-volt AC current power source. It would be advantageous to provide an LED light source with a rechargeable battery pack that could also be recharged from a 12 to 18 volt DC system, such as is commonly found in cars. It would also be desirable to have a portable light that could interchangeably use standard flashlight batteries. It is a still further object of this invention to provide a bright LED illuminated flashlight with flashing options and rechargeable batteries where the batteries can be recharged from a 12 volt DC current booster outlet.

Other and further objects of this invention will become apparent upon reading the below described specification.

BRIEF DESCRIPTION OF THE DEVICE

A very bright, portable illumination device has a cylindrical body with top and bottom end caps and a clear cylindrical center portion. Inside the clear cylindrical body is a circuit board containing a number of LEDs as well as circuitry for charging and flashing the system. The circuitry allows the user to illuminate the LEDs in a constant fashion, such as found in a flashlight, or to illuminate some of the LEDs constantly while flashing the other LEDs. This option is provided through standard circuitry and electronic chip technology. The LED light can accept either standard or rechargeable batteries and can be charged from an external DC power source. Protection in case of accidental reverse polarity and a charge timer are built into the charging circuitry to protect the apparatus and to properly charge the rechargeable batteries.

BRIEF DESCRIPTION OF THE DRAWING FIGURES

DETAILED DESCRIPTION OF THE PREFERRED EMBODIMENT

Figure 1:
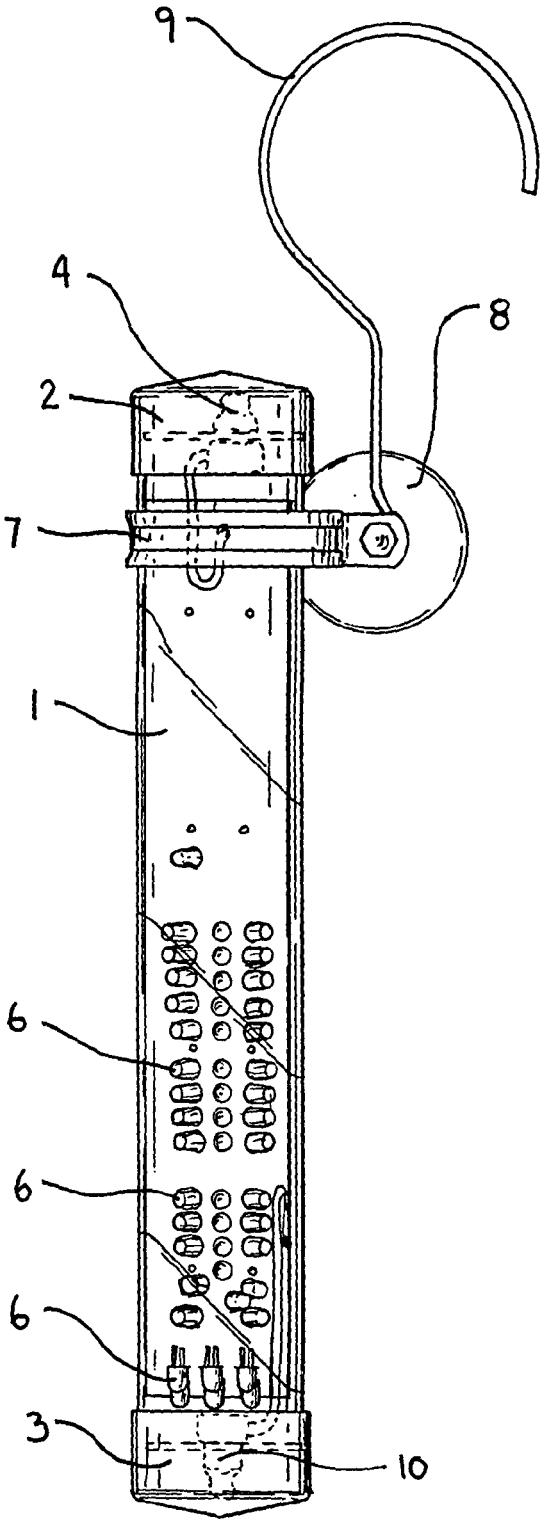
FIG. 1 is a front view of the LED lighting and flashing apparatus.

A rechargeable LED lighting and flashing apparatus has an elongated, clear, hollow cylindrical body 1. The body is generally in the shape of a cylinder, having a circular cross section. However, it is to be appreciated that this particular light may take a different shape or may have a square or rectangular cross section. The clear cylindrical body 1 is generally made of hard plastic or other clear, durable material. The cylindrical body has a flexible removable top cap 2 and a flexible bottom cap 3. These caps are removable so as to allow the user access to the top 4 and bottom 10 switches of the device.

Figure 2:
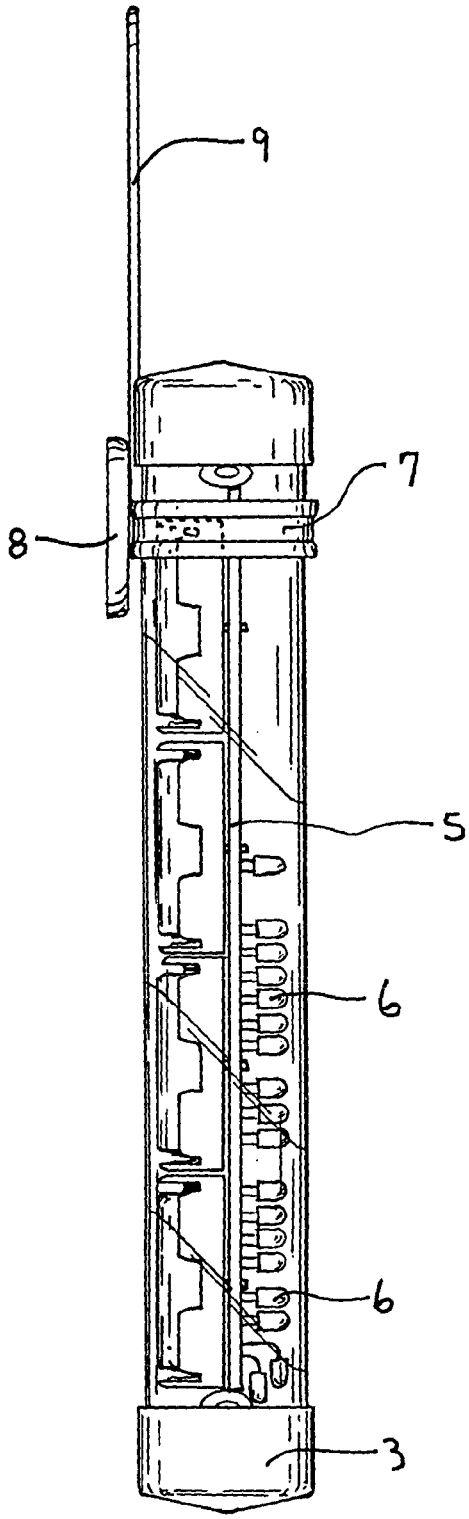
FIG. 2 is a left side view of the LED lighting and flashing apparatus.
Figure 3:
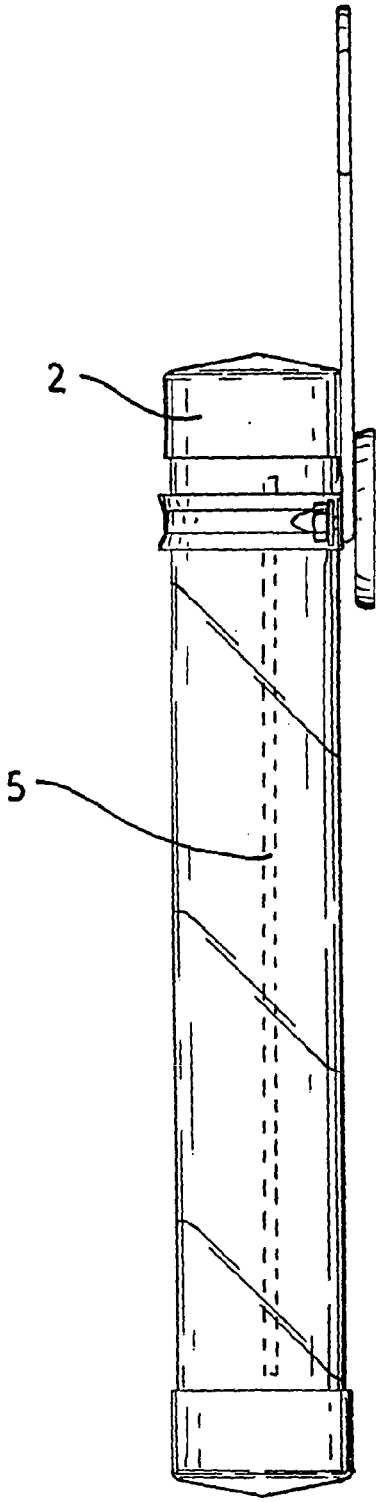
FIG. 3 is a right side view of the apparatus.
Figure 5:
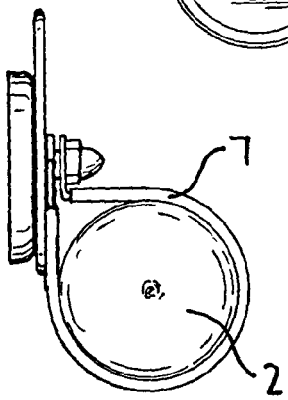
FIG. 5 is a top view of the apparatus.
Figure 6:
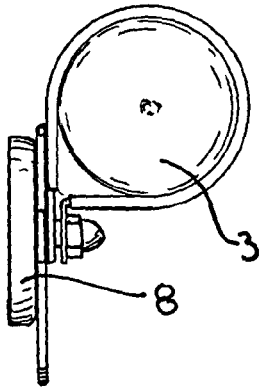
FIG. 6 is a bottom view of the apparatus.
Figure 4:
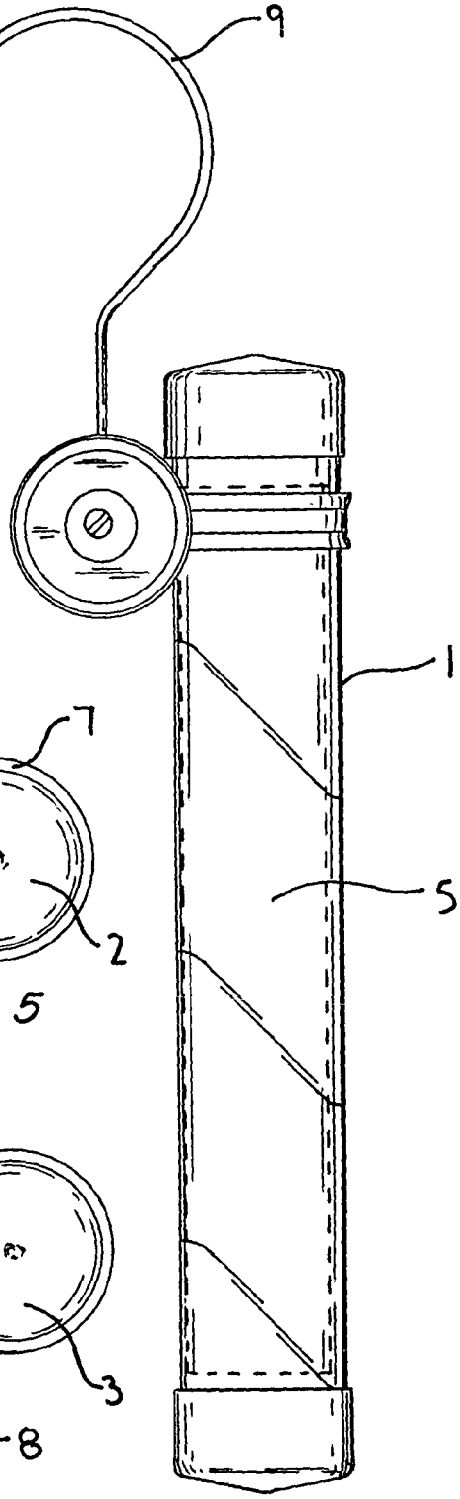
FIG. 4 is a rear view of the apparatus.

Inside the cylindrical body 1 is a standard circuit board 5. This circuit board is shown in dotted lines in FIGS. 3 and 4. The internal circuit board is fixed inside of the cylindrical body 1 and contains a number of light emitting diodes (LEDs) 6. Generally, these LEDs are located as in FIGS. 1 and 2. Any number of LEDs may be utilized in practicing this invention. However, the preferred design embodiment is shown and described best in drawing FIGS. 1 and 2.

This light is for use at work and at construction sites, and has different types of fastening means available. A collar 7 is located around the circumference of the cylindrical body 1, near the top. This collar 7 is attached to a collar magnet 8 and a collar hook 9. The magnet or hook may be utilized to attach the light to a pipe or other device or to magnetically position the rechargeable apparatus to a metal surface.

Figure 7:
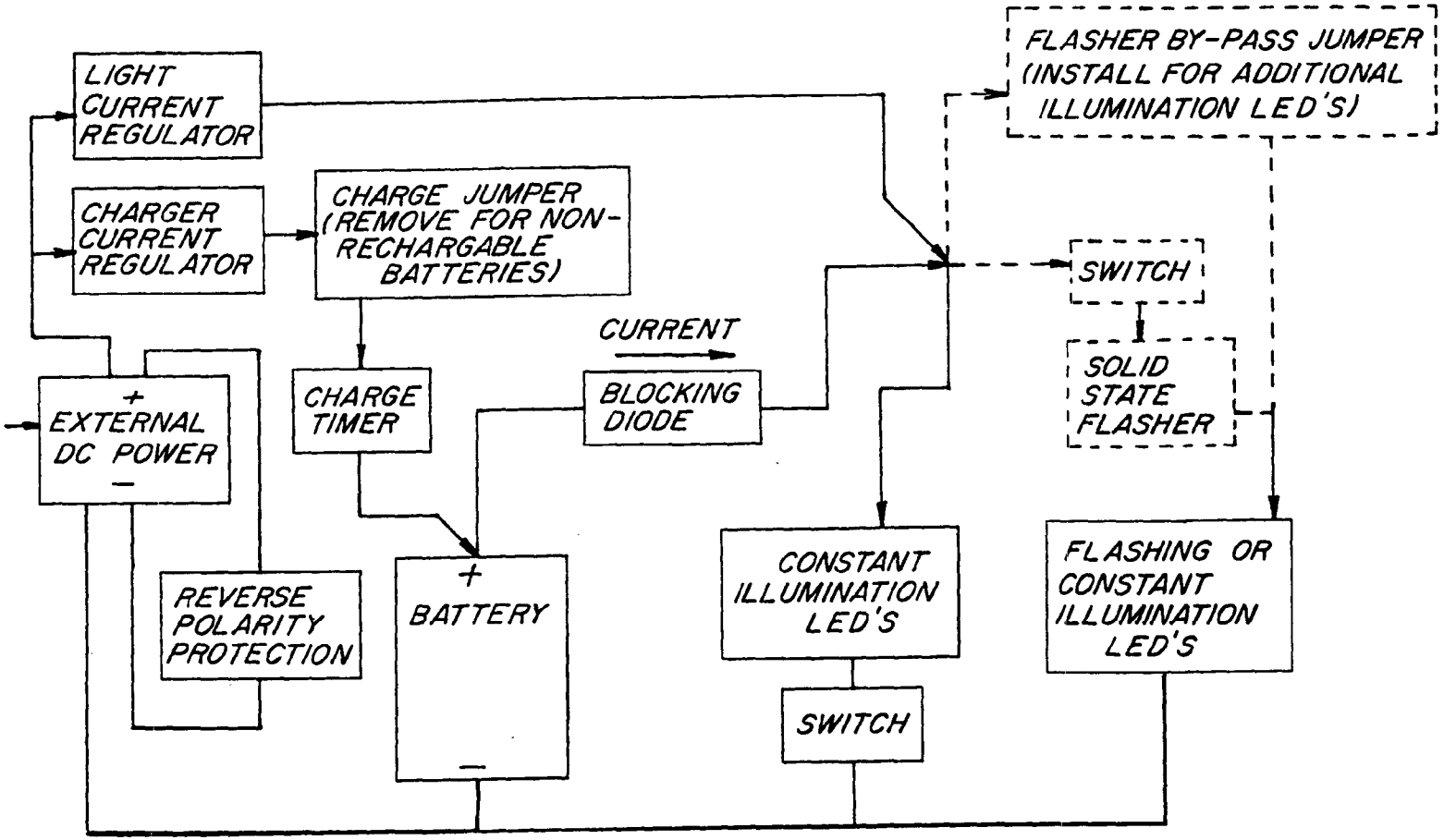
FIG. 7 is a block diagram of the electrical circuitries utilized in the device.

FIG. 7 is a block diagram showing the various electrical circuitries utilized in the device. Turning to FIG. 7, the electronic circuitry employed in practicing this device is illustrated. The power for the device (either external power or batteries) is connected to the electrical circuit by a polarized, panel mounted receptacle. A reverse polarity protection circuit automatically routes the external power to the ground through an automatic reset fuse if the polarity of the external power is accidentally reversed.

External power is electrically connected to two linear current regulators. One regulator supplies a fixed current to recharge the batteries. The other regulator supplies a fixed current to the LEDs. In the charging mode, regulated current is sent through a removable shunt to a timer circuit. The timer circuit starts charging the batteries when an external power source is connected to the device. The timer stops recharging the batteries after a programmed period of time.

Regulated current is also sent to the LEDs. A blocking diode is in place to prevent this current from going to the batteries while the LEDs are in use. When no external power is connected, the batteries provide unregulated current to the LEDs. The current through the LEDs is limited by the total forward voltage drop characteristic of the LEDs and the voltage available from the batteries. This circuitry maximizes the efficiency of energy conversion from the batteries into LED illumination.

The LEDs can be turned on and off by a first switch (generally at 4) which may be connected to either the positive or the negative side of the LEDs. A second, optional switch 10 connects a solid-state flasher circuit to some of the LEDs. This circuit pulses some of the LEDs at a programmed rate. It is to be appreciated that this flashing circuit can be connected to a different number of LEDs, depending on the particular need of the end user. It is within the spirit and disclosure of this invention to provide an LED flashing circuit for a plurality of the LEDs. This flashing circuit could also include a strobe effect, a linear flashing effect, a chasing effect or any other similar effects. The flashing effects can be accomplished by standard electronic chip technology.

If the flashing function is not required, all of the LEDs can be used for illumination by simply bypassing the optional switch and flash circuit. Utilizing this feature, maximum illumination by the LEDs will be produced.

The rechargeable LED lighting and flashing apparatus, as shown and described, can take different forms while still keeping within the spirit and disclosure of this invention. Different arrangements for the LEDs, additional flashing circuitry, and additional external power source capabilities (for example, a 120 volt external power source) can also be added to the circuitry while still keeping within the spirit of this disclosure.

Having fully described my invention, I claim:

1. An LED lighting and flashing apparatus comprising:

a) an elongated, clear, hollow body having top and bottom removable caps;

b) an internal circuit board having a plurality of LED illumination lights;

c) a power supply including batteries and a means to recharge said batteries;

d) a first switch to provide for constant illumination for a first set of fewer than all of said plurality of LED lights;

e) a solid-state flashing circuit, electrically connected to a second set of fewer than all of the LED lights, wherein said second set of LED lights are different from said first set of LED lights and wherein said second set of LED lights are pulsed at a programmed rate to create a visual effect when a second switch is energized;

(e) a second switch, electrically connected to said power supply, said flashing circuit and said second set of LED lights, to pulse said second set of LED lights at a programmed rate to create a visual effect;

(f) a means for bypassing said second switch and flashing circuit, including a bypass wire, wherein said bypassing means may be utilized to light up all of said LED lights.

2. An LED lighting and flashing apparatus, as in claim 1, wherein said visual effect is a strobe effect.

3. An LED lighting and flashing apparatus, as in claim 1, wherein said visual effect is a linear flashing effect.

4. An LED lighting and flashing apparatus as in claim 1, wherein said visual effect is a chasing effect.

5. An LED lighting and flashing apparatus as in claim 1, wherein said batteries are rechargeable, further comprising a timer circuit electrically connected between an external power source and said rechargeable batteries, wherein said timer circuit stops the charging of the batteries after a programmed amount of time.

6. An LED lighting and flashing apparatus as in claim 1, further comprising a blocking diode, wherein said blocking diode prevents current from an external power source from going to said LEDs while the LEDs are illuminated.

* * * * *